US005746568A

United States Patent [19]

Ogawa et al.

[11] Patent Number: 5,746,568

[45] Date of Patent: May 5, 1998

[54] ARTICLE COMBINING DEVICE

[75] Inventors: Hiroshi Ogawa; Seiichi Sugita; Toshio Sato, all of Tokyo, Japan

[73] Assignee: Juki Corporation, Tokyo, Japan

[21] Appl. No.: 628,312

[22] Filed: Apr. 5, 1996

[30] Foreign Application Priority Data

Apr. 7, 1995 [JP] Japan ..... 7-082744

[51] Int. Cl.[6] ..... B65H 29/38

[52] U.S. Cl. ..... 414/789.6; 414/790.7; 414/794.7

[58] Field of Search ..... 414/788.4, 789.6, 414/790.7, 794.7; 271/279, 213, 214, 215

[56] References Cited

U.S. PATENT DOCUMENTS

| | | | |
|---|---|---|---|
| 2,260,540 | 10/1941 | Schramm | 414/788.4 |
| 3,208,603 | 9/1965 | Kinker | 414/790.7 |
| 3,712,186 | 1/1973 | Lulie et al. | 414/788.4 |
| 3,978,571 | 9/1976 | Orlando et al. | 414/788.4 |
| 4,381,107 | 4/1983 | Armiger | 270/58 |
| 5,238,120 | 8/1993 | Ballestrazzi et al. | 414/790.7 |
| 5,372,472 | 12/1994 | Winski et al. | 414/789.6 |
| 5,405,240 | 4/1995 | Uno | 414/790.7 |
| 5,462,399 | 10/1995 | Clipper et al. | 414/789.6 |

FOREIGN PATENT DOCUMENTS

651526 A5 9/1985 Switzerland .

*Primary Examiner*—David A. Bucci
*Assistant Examiner*—Douglas Hess
*Attorney, Agent, or Firm*—Morgan, Lewis & Bockius LLP

[57] ABSTRACT

An article combining device includes: an article combining portion where articles are placed; an article carrying-in portion having a plural number of article carrying-in paths for carrying article into the article combining portion, the directions of carrying articles from the plural number of article carrying-in paths into the article combining portion intersecting in the article combining portion, and an article carrying-in portion for superposing the plural number of articles received from the article carrying-in paths one upon another in the article combining portion; and an article carrying-in control portion for adjusting the order of carrying articles from the article carrying-in paths into the article combining portion in accordance with information for designating the order of superposing the articles.

4 Claims, 4 Drawing Sheets

ARTICLE COMBINING DEVICE

BACKGROUND OF THE INVENTION

The present invention relates to an article combining device in use with an automatic enclosing/sealing apparatus.

There is known an automatic enclosing/sealing apparatus which is capable of enclosing articles (bills, invitation notes, and the like) having the same format, such as those of direct mails, into envelopes and sealing the envelopes.

The automatic enclosing/sealing apparatus is provided with an article combining device for preparing a set of the articles to be enclosed. The article combining device combines different kinds of sheets received from different article transporting lines and superposes them one upon another to form a set of articles to be enclosed. The set of the articles is carried out of the device, and enclosed and sealed in an envelope.

FIG. 1 is a perspective view showing a conventional article combining device 100 used in the automatic enclosing/sealing apparatus. Here, the articles to be enclosed are sheets.

Transporting fins 102 are formed on a transporting belt 101 while being equidistantly arrayed therealong. The transporting belt 101 is driven to move in the direction of an arrow 103 by a drive source, not shown. Carrying-in paths 104 and 105 are disposed on the side of the transporting belt 101. The carrying-in path 105 is located upstream of the carrying-in path 104 in the transporting direction (of an arrow 103) of the transporting belt 101. Sheets 106 and 107 are put on the transporting belt 101 at the exit portions of the carrying-in paths 104 and 105, and carried in the direction of an arrow 103 with the aid of the transporting fins 102. In this case, the sheets 106 and 107 are supported with the transporting fins 102 and pushed forward.

To be more specific, the sheet 107 is put on the transporting belt 101 at the exit portion of the carrying-in path 105. Then, the sheet 107 is transported up to a location where the carrying-in path 104 is provided, by the transporting belt 101. The sheet 106 is put on the sheet 107 at the exit portion of the carrying-in path 104. Thus, the sheet 106 is put on the sheet 107 to form an article to be enclosed, and the article is transported in the direction of an arrow 103.

In case where a plural number of sheets 106 or 107 are carried into the carrying-in path 104 or 105, a stacking means (not shown) for stacking the sheets is provided upstream of the carrying-in path 104 or 105. The sheets are stacked by the stacking means and the resultant is carried into the carrying-in path 104 or 105.

In the article combining device 100, the transporting belt 101 is moved in the direction of the arrow 103 and passes the exit portions of the carrying-in paths 104 and 105. Accordingly, the articles (sheets 106 and 107) are superposed such that the article (sheet 106) carried in from the carrying-in path 104 is placed on the article (sheet 107). In other words, the order of superposing the articles is uniquely determined depending on which of the carrying-in paths 104 and 105 is located upstream of the article transportation.

In the article combining device, if the carrying-in path 105 is constructed so as to satisfy the specifications for the structure of carrying in the sheet 107, but not to satisfy the specifications for the structure of carrying in the sheet 106, the article combining portion cannot superpose the sheet 107 on the sheet 106.

In case where the carrying-in path 104 of the article combining device 100 is constructed so as to receive only the sheets of a continuous paper with something printed thereon by a printer, series of circular holes for the tractor feeder of the printer are formed in both side parts of the continuous paper, and hence a cutting means for cutting off the side parts from the continuous paper is provided for the carrying-in path 104. In this case, if the carrying-in path 105 is constructed so as to receive only single papers, the cutting means is not provided for the carrying-in path 105.

In this case, the carrying-in path 105 cannot handle the continuous paper, and for this reason, the article combining device 100 cannot superpose the single paper on the continuous paper.

Accordingly, an object of the present invention is to provide an article supplying device which is capable of properly setting the order of superposing articles without any limit of the forms of the articles.

In case where the sheet 107 or 107 carried by the carrying-in path 104 or 105 comprises a plural number of single papers, a conventional art uses a stacking means (not shown) located in the upper part of the carrying-in path 104 or 105. Those single papers are stacked by the stacking means, and the resultant stack is moved toward the lower part of the carrying-in path 104 or 105. In this connection, if the single papers are stacked without using the stacking means, the size reduction of the article combining device will be realized.

Accordingly, another object of the present invention is to provide an article combining device which is capable of stacking a plural number of articles without using the article stacking means before the articles are combined, to thereby reduce the size of the article combining device.

SUMMARY OF THE INVENTION

According to a first aspect of the present invention, there is provided an article combining device comprising: an article combining portion where articles are placed; article carrying-in means having a plural number of article carrying-in paths for carrying article into the article combining portion, the directions of carrying articles from the plural number of article carrying-in paths into the article combining portion intersecting in the article combining portion, and article carrying-in means for superposing the plural number of articles received from the article carrying-in paths one upon another in the article combining portion; and article carrying-in control means for adjusting the order of carrying articles from the article carrying-in paths into the article combining portion in accordance with information for designating the order of superposing the articles.

According to a second aspect of the invention, there is provided an article combining device comprising: an article combining portion where articles are placed; article carrying-in means having a plural number of article carrying-in paths for carrying article into the article combining portion, the directions of carrying articles from the plural number of article carrying-in paths into the article combining portion intersecting in the article combining portion, and article carrying-in means for superposing the plural number of articles received from the article carrying-in paths one upon another in the article combining portion; vertical level adjusting means for adjusting a vertical level of one article relative to another article and vice versa when those articles are carried into the article combining portion; and article carrying-in control means for causing the vertical level adjusting means to adjust the vertical level in accordance with information for designating the order of superposing the articles, and for concurrently carrying a plural number of articles into the article combining portion from the article carrying-in paths.

According to a third aspect of the invention, there is provided the article combining device according to either one of the first or second aspect, further comprising: blocking means, provided in an exit portion of at least one of the plural number of article carrying-in paths, for blocking the advancement of the article from the exit portion to the article combining portion in the exit portion, to thereby stack the plural number of incoming articles in the exit portion; article sensing means, provided in each the exit portion, for detecting a kind of the articles, the advancement of which is blocked in the exit portion by the blocking means; and carrying-in preparation/control means operating such that, in accordance with information for designating a plural number of articles to be carried into the article combining portion from the individual article carrying-in paths having the article sensing means provided therein, the carrying-in preparation/control means judges that the plural number of articles have been stacked in the exit portion, by a signal derived from the article sensing means, and then releases the articles from their state being blocked by the blocking means, to thereby allow the plural number of article to be carried into the article combining portion.

DETAILED DESCRIPTION OF THE PREFERRED EMBODIMENTS

Figure 1:
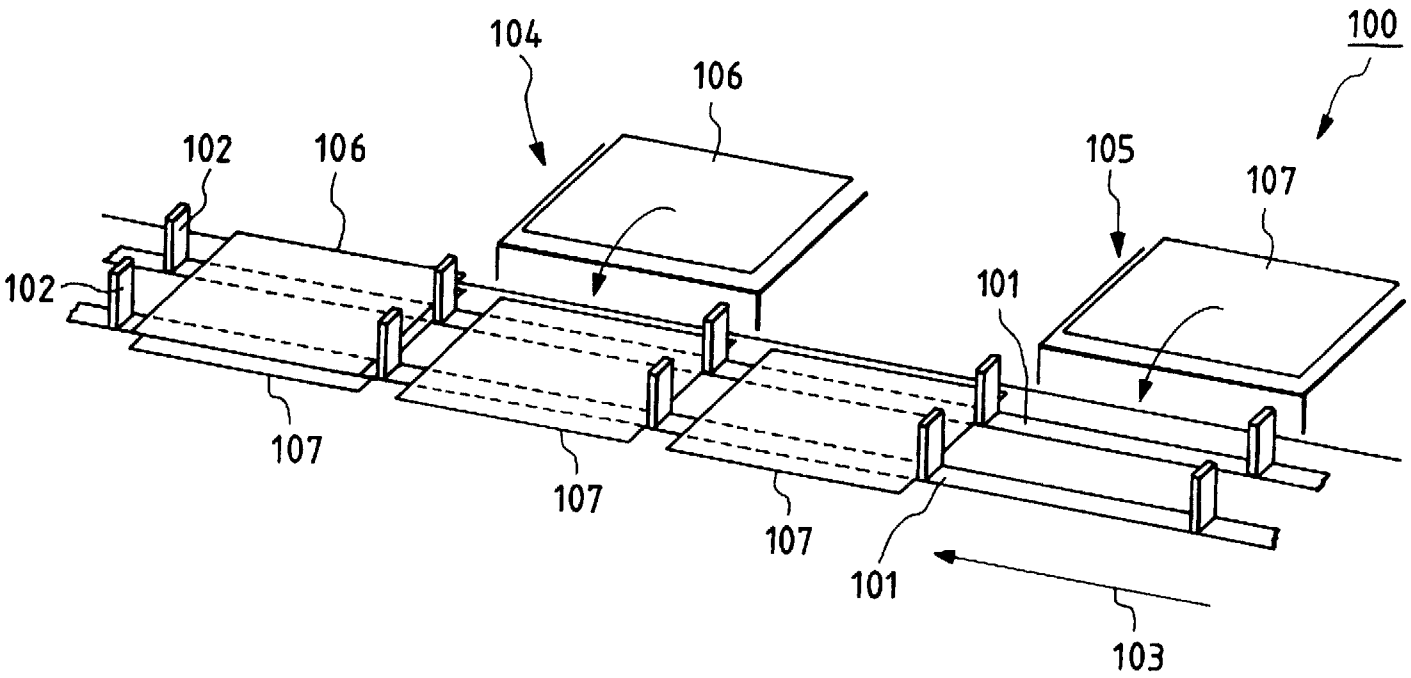
FIG. 1 PRIOR ART
FIG. 1 is a perspective view showing a conventional article combining device.
Figure 2:
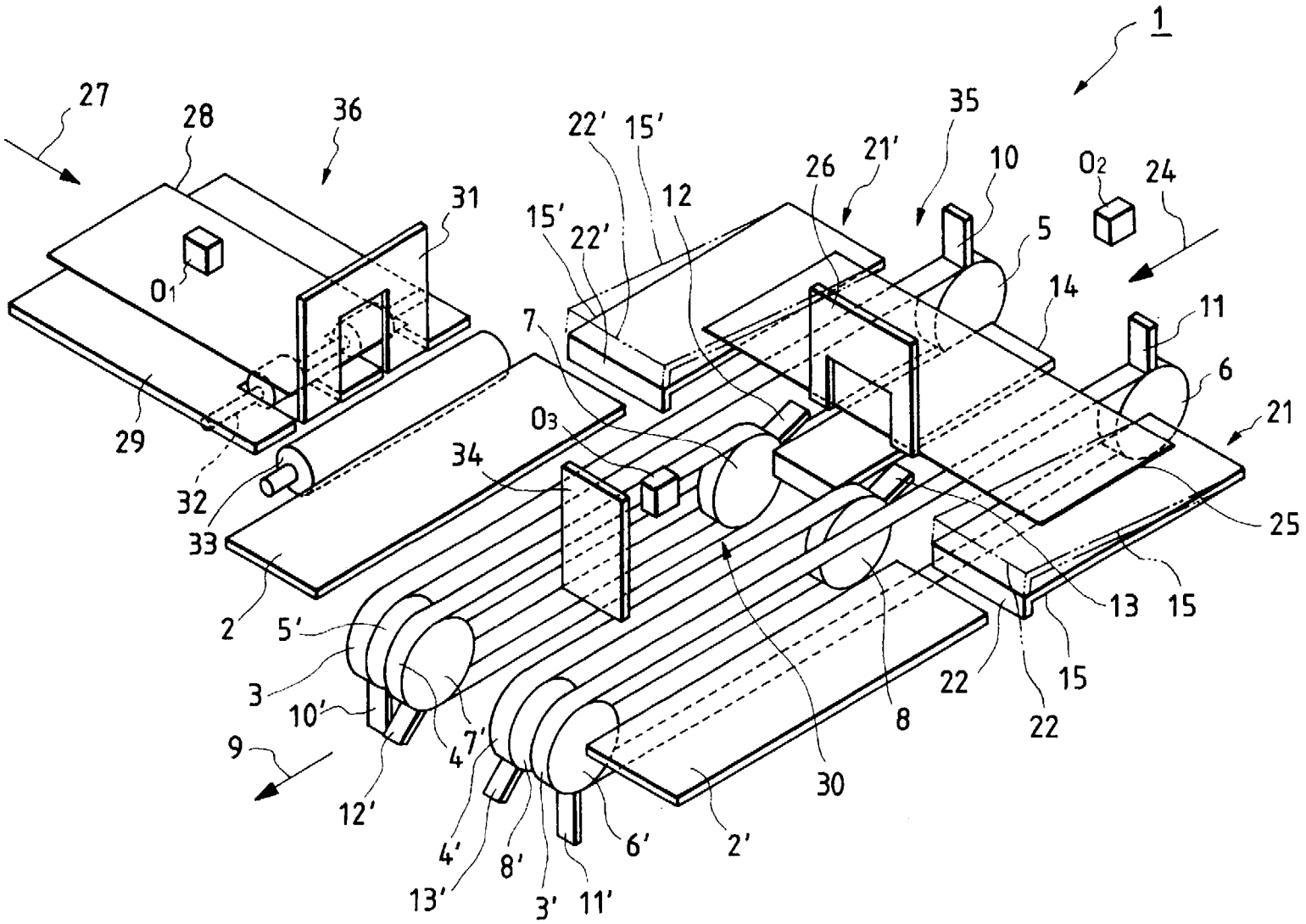
FIG. 2 is a perspective view showing an embodiment of an article supplying device according to the present invention.
Figure 3:
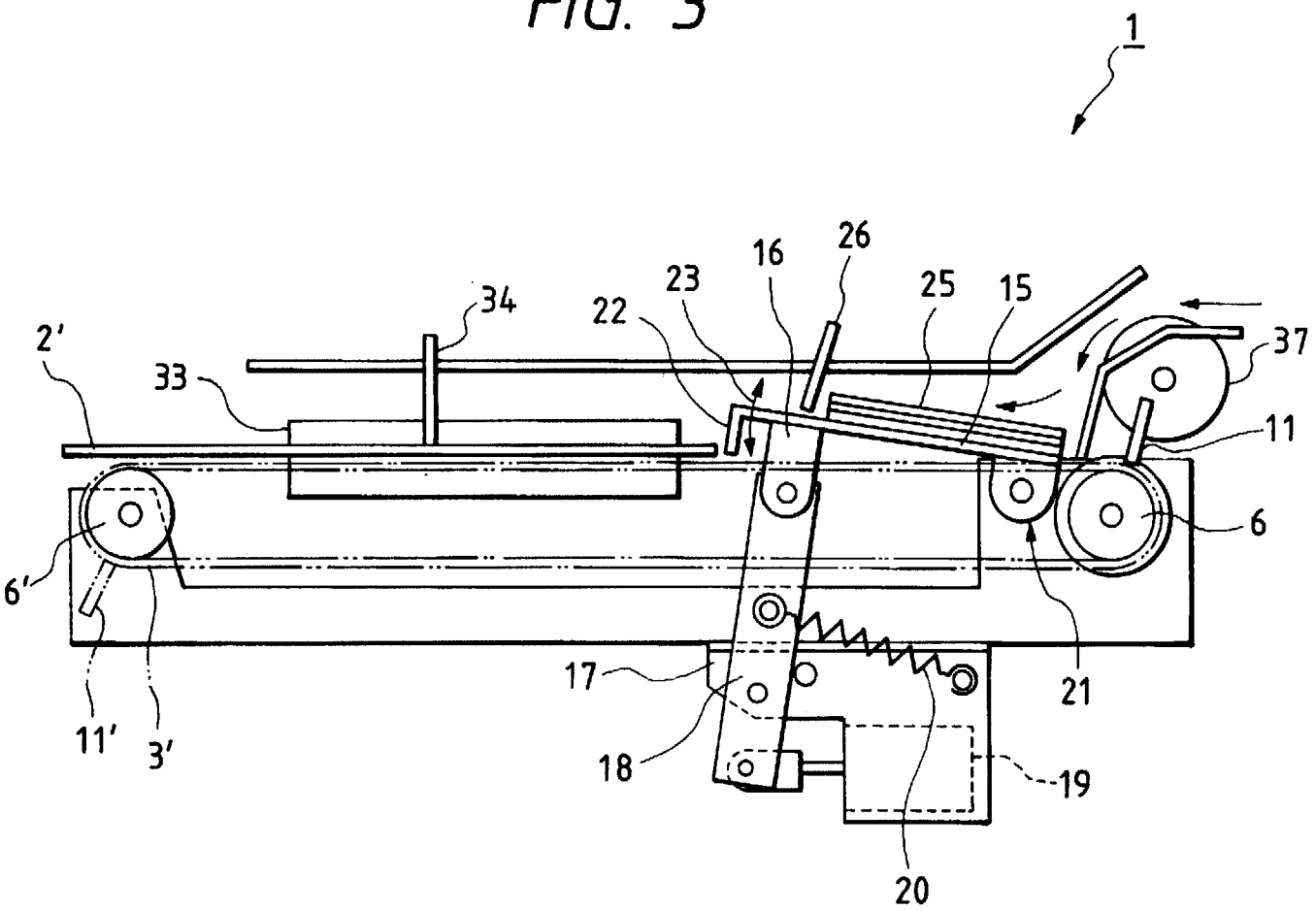
FIG. 3 is a side view showing the embodiment of an article supplying device according to the present invention.

FIG. 2 is a perspective view showing a first embodiment of an article supplying device 1 according to the present invention. FIG. 3 is a side view showing thereof.

The embodiment of the present invention will be described with reference to the accompanying drawings.

A pair of transporting tables 2 and 2' are disposed in parallel while being spaced a predetermined distance from each other. A pair of transporting belts 3 and 3' and another pair of transporting belts 4 and 4' are disposed in parallel between the paired transporting tables 2 and 2'. The transporting belts 3 and 3' have respectively pairs of transporting fins 10 and 10', and 11 and 11', and the transporting belts 4 and 4' have respectively pairs of transporting fins 12 and 12', and 13 and 13'. The distances each between the paired transporting fins of the transporting belts are equal to each other.

The transporting belt 3 is put around a belt drive pulley 5 and a belt tension pulley 5'. The transporting belt 3 is put around a belt drive pulley 6 and a belt tension pulley 6'. The transporting belt 4 is put around a belt drive pulley 7 and a belt tension pulley 7'. The transporting belt 4' is put around a belt drive pulley 8 and a belt tension pulley 8'. The transporting belts 3, 3', 4 and 4' are driven by the belt drive pulleys 5, 6, 7 and 8, respectively, so that a sheet to be described later is moved in the direction of an arrow 9. The belt tension pulleys 5', 6', 7' and 8' are disposed between the transporting tables 2 and ' in a state that these pulleys are aligned in the direction perpendicular to the direction of the arrow 9. An interval between the paired pulleys 7 and 7' is shorter than that between the paired pulleys 5 and 5'. Similarly, an interval between the paired pulleys 8 and 8' is shorter than that between the paired pulleys 6 and 6'. Thus, the pulleys 7 and 8 are located closer to the arrow 9 than the pulleys 5 and 6.

A carrying-in exit plate 14, extending in the transporting direction of the belts 3 and 4, is disposed between the transporting belts 3 and 3' in a state that the leading end of the carrying-in exit plate 14 is located between the transporting belts 4 and 4'. The upper surface of the carrying-in exit plate 14 is somewhat higher than the upper surfaces of the transporting tables 2 and 2'.

First pool tables 15 and 15' are respectively located outside the transporting belts 3 and 3' while being disposed parallel to the carrying-in exit plate 14. Base parts 21 and 21', which are respectively provided on the undersides of the rear ends of the first pool tables 15 and 15', are rotatably supported by a frame. A table lift lever 16 is provided on the underside of the fore end of the first pool table 15. An arm 18, of which the top end is rotatably coupled with the table lift lever 16, is rotatably supported by a hinge 17 of which the middle part is supported by the frame. A table solenoid 19 is secured to the hinge 17, and a drive part of the table solenoid 19 is coupled with the bottom end of the arm 18. One end of a spring 20 is coupled with the arm 18, and the other end thereof is coupled with the hinge 17. The arm 18 is turned while resisting the urging force of the spring 20 when the table solenoid 19 is energized. The first pool table 15 is vertically turned about the base part 21 in the direction of arrows 23 when the arm 18 is turned.

A carrying-in roller 37, provided in a first article carrying-in path, carries a sheet 25 into an exit portion 35. The direction in which a given sheet 25 is carried thereinto along a first carrying-in path (not shown), is parallel to the belts 3 and 4 as indicated by an arrow 24. A first pool gate 26, when it is at the lowered position, blocks the advancement of the sheet 25 and locates it in the carrying-in exit plate 14 and the first pool tables 15 and 15'. Incidentally, the first pool gate 26 is lifted and lowered on the carrying-in exit plate 14 by a well known lifting mechanism (not shown), such as a solenoid or an air cylinder. The exit portion 35 through which the sheet 25 goes out of the first carrying-in path is defined by the carrying-in exit plate 14 and the upper surfaces of the first pool tables 15 and 15'. When the first pool gate 26 is lifted, the sheet 25 is set free and caught by transporting fins 10 and 11 or 10' and 11' of the belts 3 and 3' driven by a drive source (not shown), and moved forward in the direction of the arrow 9. The sheet 25 is carried into an article combining portion 30 located between the transporting tables 2 and 2', and placed therein. At this time, the sheet 25 is supported on the transporting tables 2 and 2', and the transporting belts 3 and 3', and 4 and 4'.

Another sheet 28 is moved in the direction of an arrow 27 that intersects the belts 3 and 4, and carried onto a second pool table 29, from a second carrying-in path (not shown). A second pool gate 31 may be lifted and lowered by a well known lifting mechanism (not shown). When the sheet 28 is carried into the second pool table 29, it is blocked in its advancement by the lowered second pool gate 31, and placed on the second pool table 29. The upper surface of the second pool table 29 is somewhat higher than the surfaces of the transporting tables 2 and 2'. When the first pool tables 15 and 15' are lifted, the upper surfaces of the second pool table 29 is somewhat lower than the fore end parts 22 and 22' of the first pool tables 15 and 15'. When the first pool tables 15 and 15' are lowered, the upper surfaces of the second pool table 29 is somewhat higher than the fore end parts 22 and 22' of the first pool tables 15 and 15'. A space above the second pool table 29 serves as an exit portion 36 through which the sheet 28 goes out of the second carrying-in path. The sheet 28, located on the second pool table 29, is carried into the article combining portion 30 with the aid of the carrying-out roller 32 and the carrying-in roller 33.

The sheets 25 and 28 are carried from the first and the second article carrying-in paths into the article combining portion 30 in the different directions (of the arrows 24 and 27), viz., in the directions intersecting in the article combining portion. Those sheets 25 and 28, which are thus carried from the first and the second article carrying-in paths into the article combining portion 30, are stacked in the article combining portion 30. A combining portion gate 34 is lifted and lowered by a well known lifting mechanism (not shown). The combining portion gate 34 stops the advancement of the sheets 25 and 28 when those sheets are introduced into the article combining portion 30.

The sheet 25 comprises, for instance, a stack of plural kinds of single papers. A plural number of hoppers (not shown) are provided for the first carrying-in path, and single papers are stacked in each hopper. A sheet taking-out device (not shown) is provided for each hopper. The single papers are taken out of the hopper by the sheet taking-out device, and fed into the first carrying-in path.

Sensors $O_1$, $O_2$ and $O_3$ for sensing various types of sheets are provided on the exit portion 35 of the first article carrying-in path, the exit portion 36 of the second article carrying-in path, and the article combining portion 30, respectively. An OMR (optical mark reader) for reading marks put on each sheet is an example of each of those sensors.

A control unit (not shown) is included in the article combining device 1. A CPU (central processing unit) is contained in the control unit, and performs various types of operations under control of predetermined programs, and sends control signals to the respective portions in the article combining device 1.

The CPU vertically positions the first pool tables 15 and 15' in accordance with input data for specifying the order of stacking the sheets 25 and 28. The CPU controls the operation of carrying the sheets 25 and 28 into the article combining portion 30 so that these sheets are simultaneously carried thereinto from the first and the second article carrying-in path. The input data is entered through the keyboard operation by an operator, the mark reading operation by the OMR or the like at a place upstream of the first pool tables.

A number of single papers, which are carried from the first carrying-in path into the article combining portion 30, is designated by input data. The input data is compared with the output signals of the sensors $O_1$ and $O_2$ by the CPU. When recognizing that all the single papers have been stacked at the exit portion 35 to form a sheet 25, the CPU lifts the first pool gate 26, to thereby release the sheet 25 from its blocked state. The sheet 25 comprising a stack of the single papers is carried into the article combining portion 30.

The control unit includes a ROM (read only memory), a RAM (random access memory), and a given input unit, such as the keyboard or OMRs. The ROM is a nonvolatile memory for storing predetermined control programs. The RAM is a volatile memory for temporarily storing the results of operations, for example.

The operation of the article combining device embodying the present invention will be described.

Figure 4:
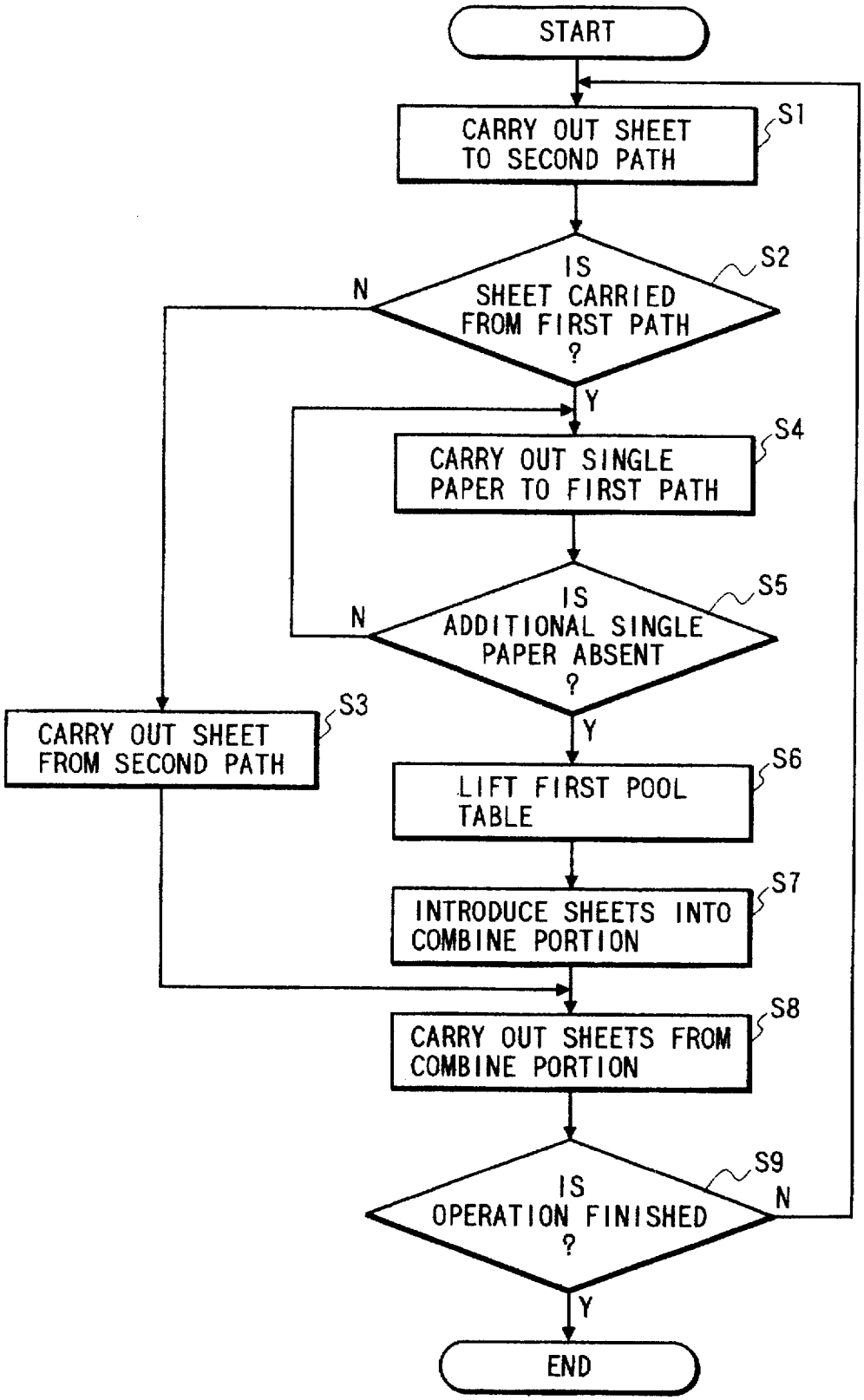
FIG. 4 is a flow chart showing the operation of the embodiment of an article supplying device according to the present invention.

FIG. 4 is a flow chart showing the operation of the present embodiment.

An example where a main sheet as the sheet 28 is carried from the second article carrying-in path into the article combining portion 30 and a sub-sheet as the sheet 25 is carried from the first article carrying-in path into the article combining portion 30, will be described.

Step 1

The sheet 28 (main sheet) is carried out to the second article carrying-in path. The sheet 28 reaches the exit portion 36, and its advancement is blocked therein by the second pool gate 31. The arrival of the sheet 28 at the exit portion 36 is sensed by the sensor $O_1$ provided on the exit portion 36.

Step 2

Data indicating whether or not the sheet 25 (sub-sheet) is carried from the first article carrying-in path into the article combining portion 30 and combined with the sheet 28 has been stored into a recording medium by the input unit. The CPU judges whether or not those sheets are to be combined. If the sheets are not to be combined, the CPU advances to a step S3. If the sheets are to be combined, the CPU advances to a step S4.

Step 4

Data designating the hopper from which the single paper is to be taken out has been stored in the recording medium by the input unit. A given hopper located upstream of the first article carrying-in path is designated by the data, and the single paper is taken out of the hopper and carried out into the first article carrying-in path.

Step 5

Data indicating a number of single papers to be tacked has been stored in the recording medium by the input unit. A kind of the single paper, arrived at the exit portion 35, is sensed by the sensor $O_2$ on the exit portion 35. The CPU compares the data with the output signal of the sensor, and judges whether or not an additional single paper to be put on the current single paper is present. If the additional single paper is present, the CPU returns to the step S4 where the additional single paper is fed out into the first article carrying-in path as in the above case. The additional single paper is blocked in its advancement by the first pool gate 26, and put on the single paper already stopped by the blocking by the same gate. A kind of the single paper is detected by the sensor $O_2$ on the exit portion 35. The CPU compares the output signal of the sensor with that data, and judges whether or not an additional single paper to be put on the current single paper is present. If the additional single paper to be put on the current single paper is absent, the CPU advances to a step S6.

step 6

Data indicating whether the first pool tables 15 and 15' are to be lifted or lowered has been stored into the recording medium by the input unit. A sheet 25 (sub-sheet) as a stack of single papers formed at the exit portion 35 and a sheet 28 (main sheet) coming from the exit portion 36 are combined in a superposing fashion in the article combining portion 30. The lifting or the lowering of the first pool tables 15 and 15' depends on which of the sheet 25 and the sheet 28 is placed on the other. For example, when the sheet 25 is placed on the sheet 28, the first pool tables 15 and 15' are driven to ascend by the table lift solenoid 19. When the sheet 28 is placed on the sheet 25, the first pool tables 15 and 15' are driven to descend by the table lift solenoid 19. Thus, a vertical level of the sheet 25 relative to the sheet 28 and vice versa, when carried into the article combining portion 30, is adjusted through the vertical movement of the first pool tables 15 and 15'.

Step 7

The first and the second pool gates 26 and 31 are opened by drive mechanisms (not shown), the carrying-out roller 32 and the carrying-in roller 33, and the transporting belts 3 and 3' are driven, and the sheets 25 and 28 are concurrently introduced into the article combining portion 30. The sheets 25 and 28 are superposed one upon the other in the article combining portion 30. When the first pool tables 15 and 15' are lifted and the fore end parts 22 and 22' thereof are higher than the surface of the second pool table 29, the sheet 25 is placed on the sheet 28. When the first pool tables 15 and 15' are lowered and the fore end parts 22 and 22' thereof are lower than the surface of the second pool table 29, the sheet 28 is placed on the sheet 25.

Step 3

When in the step S2, the sheet 25 (sub-sheet) is not introduced from the first article carrying-in path into the article combining portion 30 and hence is not combined with the sheet 28, only the sheet 28 that was introduced into the exit portion 36 in the step S1 is introduced into the article combining portion 30 after the second pool gate 31 is opened.

The sheets 25 and 28 are blocked in their advancement in the article combining portion 30 by the combining portion gate 34. The sensor $O_3$ on the article combining portion 30 detects the presence or the absence of the sheets 25 and 28 or the sheet 28 in the article combining portion 30.

Step 8

In this way, the sheets 25 and 28 are introduced into and combined in the article combining portion or the sheet 28 is solely introduced thereinto in the step S7 or S3. The combined sheets or the sole sheet is transported in the direction of the arrow 9 by the transporting belts 3 and 3' or the transporting belts 4 and 4' after the combining portion gate 34 is opened by the drive mechanism (not shown).

When the sheets 25 and 28 are combined and superposed one upon the other in the article combining portion 30, the combined sheets 25 and 28 are transported out of the article combining portion by the transporting belts 3 and 3'. When the sheet 28 is solely introduced into the article combining portion 30, the sheet 28 is transported therefrom by the transporting belts 4 and 4'. It is for this reason that the transporting belts 4 and 4' are disposed apart from the exit portion 35. Accordingly, when the sheet 28 is solely transported out of the article combining portion 30, if the subsequent sheet 25 to be transported into the article combining portion 30 arrives at the exit portion 35, the article combining device transports only the sheet 28 out of the article combining portion 30.

If a given ending operation is performed on the input unit, the operation of the article combining device is completed. If the ending operation is not performed, the CPU returns to the step S1, and executes the process of the steps S1 to S8. Under control of the CPU, new sheets 25 and 28 are selectively introduced into the article combining portion and, if so selected, combined therein, and delivered in the direction of the arrow 9 from the article combining portion.

Thus, the first and the second article carrying-in paths are constructed corresponding to the specific kinds of the sheets, as in the conventional device. (In the above-mentioned instance, the first article carrying-in path is constructed for the sub-sheet, and the second article carrying-in path, for the main sheet.) It is noted, however, that in the article combining device 1 of this embodiment, the order of superposing the sheets one upon the other is not limited by the specifications of the sheets, but may be set as desired.

Further, it is noted that in the article combining device 1 of the present embodiment, a blocking means for blocking the advancement of the sheet, i.e., the first pool gate 26 (in the above-mentioned instance), is provided in the exit portion 35 of the first article carrying-in path. A plural number of single papers are blocked in their advancement by the first pool gate 26 and stacked in the exit portion 35 of the first article carrying-in path, through the above-mentioned control by the control unit (not shown). Therefore, there is no need of providing the mechanism, which is exclusively used for stacking a plural number of single papers before the sheets 25 and 28 are combined, upstream of the first article carrying-in path. Accordingly, the size of the article combining device may be reduced.

In the above-mentioned embodiment, the order of superposing the sheets 25 and 28 is adjusted by the vertical movement of the first pool tables 15 and 15'. Alternatively, the order of introducing the sheets 25 and 28 into the article combining portion may be changed depending on the order of superposing those sheets, without providing the lifting mechanism of the table lift solenoid 19, for example, in the first pool tables 15 and 15'.

The operation of the second embodiment will be described while placing an emphasis on its differences from the operation of the first embodiment. In the operation, the single papers are all stacked in the exit portion 35 in the step S5 in the first embodiment, and then the CPU jumps to the step S7 without executing the step S6. In the second embodiment, the step S7 is different from that in the first embodiment.

Step S7

Data indicating which of the sheet 25 and the sheet 28 is placed on the other is stored in advance into the recording medium by the input unit. When the sheet 28 is placed on the sheet 25, the first pool gate 26 is opened and the sheet 25 enters the article combining portion 30 before the sheet 28. When the sheet 25 is placed on the sheet 28, the second pool gate 31 is opened and the sheet 28 enters the article combining portion 30 before the sheet 25.

Also in the second embodiment, each of the first and the second article carrying-in paths is constructed corresponding to the specific kind of the sheets, as in the conventional device. (In the above-mentioned instance, the first article carrying-in path is constructed for the sub-sheet, and the second article carrying-in path, for the main sheet.) It is noted, however, that in the article combining device 1 of the second embodiment, the order of superposing the sheets one upon the other is not limited by the specifications of the sheets, but may be set as desired.

As in the first embodiment, there is no need of providing the mechanism, which is exclusively used for stacking a plural number of single papers before the sheets 25 and 28 are combined, upstream of the first article carrying-in path. Accordingly, the size of the article combining device may be reduced.

Further, the table lift lever 16 and the arm 18, the table lift solenoid 19, the spring 20 and the like may be omitted in the second embodiment. Accordingly, the second embodiment requires a less number of necessary component parts than the first embodiment, and succeeds in reducing the size of the article combining portion and the cost to manufacture the same.

In the second embodiment, the sheets 25 and 28 are carried into the article combining portion 30 in the order of superposing them, and combined there. In the first embodiment, the sheets 25 and 28 are concurrently carried into the article combining portion 30, and superposed therein one upon the other. Therefore, the first embodiment is higher in work efficiency than the second embodiment.

It is evident that the present invention is not limited to the above-mentioned embodiments, but may variously be modified, changed and altered within the scope of the invention. For example, a third article carrying-in path may additionally be provided in the construction of the first or the second embodiment. In this case, the third article carrying-in path is disposed in opposition to the second article carrying-in path. The sheet is introduced into the article combining portion 30 in the direction opposite to the direction of the arrow 27.

The specifications of the sheets to be carried from the individual article carrying-in paths into the article combining portion are not limited to those referred to in the above-mentioned embodiments, as a matter of course. In a specific example of the construction modified in this connection, various combinations of sheets and article carrying-in paths are provided. The article carrying-in path is selected from among those paths in accordance with the specification of the sheet to be handled. Further, the single-sheet stacking mechanism provided in the second article carrying-in path may be omitted.

In the first aspect of the invention, the directions in which the articles are carried into the article combining portion, intersect in the article combining portion. A plural number of articles are carried from the article carrying-in paths into the article combining portion, and superposed one upon another in the article combining portion. The article combining portion where the articles are placed is standstill at one location. The articles are carried from the article carrying-in paths into the article combining portion, and superposed one upon another therein. There is no need of such a conventional construction that the transporting belt is moved to pass the article carrying-in paths. Accordingly, the order of superposing the articles in the article combining portion may variously be changed by changing the order of carrying the articles from the article carrying-in paths into the article combining portion. The articles that are introduced into the article combining portion from the article carrying-in paths are combined and superposed one upon another in the article combining portion. Thereafter, the article carrying-in control means controls the order of carrying the articles from the article carrying-in paths into the article combining portion in accordance with information for designating the order of superposing the articles. The order of superposing the articles may variously be adjusted without any limit by the locations of the article carrying-in paths.

Even if the article carrying-in paths are constructed so as to handle specific kinds of articles, the order of superposing articles may be properly set without any limit of the forms of the articles.

In the second aspect of the invention, the directions in which the articles are carried into the article combining portion, intersect in the article combining portion. A plural number of articles are carried from the article carrying-in paths into the article combining portion, and superposed one upon another in the article combining portion. The article combining portion where the articles are placed is standstill at one location. The articles are carried from the article carrying-in paths into the article combining portion, and superposed one upon another therein. There is no need of such a conventional construction that the transporting belt is moved to pass the article carrying-in paths. For the vertical levels of the articles introduced from the article carrying-in paths into the article combining portion, the article to be placed on another article is set at a higher vertical level by the vertical level adjusting means. When the articles are concurrently carried into the article combining portion from the article carrying-in paths, the article delivered from the article carrying-in path of which the vertical level was increased is placed on another article in the article combining portion. Thereafter, in accordance with information for designating the order of superposing the articles, the article carrying-in control means causes the vertical level adjusting means to adjust a vertical level of the article before it is carried into the article combining portion, and causes a plural number of articles to concurrently enter the article combining portion from the article carrying-in paths, whereby the order of superposing the articles may variously be adjusted without any limit by the locations of the article carrying-in paths.

As in the first aspect of the invention as set forth, even if the article carrying-in paths are constructed so as to handle specific kinds of articles, the order of superposing articles may be properly set without any limit of the forms of the articles.

In the first aspect of the invention, the operation of carrying the articles into the article combining portion is sequential. The articles are concurrently carried into the article combining portion from the article carrying-in paths, and the articles are superposed in a desired order. Therefore, the second aspect of the invention is more efficient than the first aspect in the work to combine and superpose the articles.

The third aspect of the invention has the useful effects comparable with those of the first and second aspects of the invention, and further the following useful effects.

The blocking means, provided in an exit portion of the article carrying-in path, blocks the advancement of the article from the exit portion to the article combining portion in the exit portion. The plural number of incoming articles are moved to and stacked in the exit portion. The article sensing means detects a kind of the stacked articles, the advancement of which is blocked in the exit portion by the blocking means. Information for designating a plural number of articles carried from the article carrying-in paths into the article combining portion is compared with a signal derived from the article sensing means. When a signal indicating that all of the articles have been stacked in the exit portion is outputted from the article sensing means, the carrying-in preparation/control means releases the articles from their state being blocked by the blocking means, to thereby allow the plural number of article to be carried into the article combining portion.

The stacking means exclusively used for stacking a plural number of articles before the articles are combined is not provided in the article carrying-in path. The blocking means is provided in an exit portion of the article carrying-in path, and the carrying-in preparation/control means performs the above controls. Thus, the article carrying-in path has additionally the function of the article stacking means. This fact leads to size reduction of the article combining device.

We claim:

1. An article combining device, comprising:

an article combining portion where articles are placed;

article carrying-in means having a plural number of article carrying-in paths for carrying articles into the article combining portion, the direction of carrying-in articles from the plural number of article carrying-in paths into the article combining portion intersecting at the article combining portion, and said article carrying-in means superposing the plural number of articles received from the article carrying-in paths one upon another in the article combining portion:

article carrying-in control means for adjusting the order of carrying-in articles from the article carrying-in paths into the article combining portion in accordance with information for designating the order of superposing the articles;

blocking means, provided in an exit portion of at least one of the plural number of article carrying-in paths, for blocking the advancement of the article from the exit portion to the article combining portion to thereby stack the plural number of incoming articles in the exit portion;

article sensing means, provided in each of the exit portions, for detecting a kind of the articles, the advancement of which is blocked in the exit portion by the blocking means; and carrying-in preparation/control means operating such that, in accordance with information for designating a plural number of articles to be carried into the article combining portion from the individual article carrying-in paths having the article sensing means provided therein, the carrying-in preparation/control means judges that the plural number of articles have been stacked in the exit portion, by a signal derived from the article sensing means, and then releases the articles from their state being blocked by the blocking means, to thereby allow the plural number of articles to be carried into the article combining portion.

2. An article combining device, comprising:

an article combining portion where articles are placed;

article carrying-in means having a plural number of article carrying-in paths for carrying articles into the article combining portion, the directions of carrying-in articles from the plural number of article carrying-in paths into the article combining portion intersecting in the article combining portion, and said article carrying-in means superposing the plural number of articles received from the article carrying-in paths one upon another in the article combining portion;

vertical level adjusting means for adjusting a vertical level of one article relative to another article and vice versa when those articles are carried into the article combining portion;

article carrying-in control means for causing the vertical level adjusting means to adjust the vertical level in accordance with information for designating the order of superposing the articles, and for concurrently carrying a plural number of articles into the article combining portion from the article carrying-in paths;

blocking means, provided in an exit portion of at least one of the plural number of article carrying-in paths, for blocking the advancement of the article from the exit portion to the article combining portion to thereby stack the plural number of incoming articles in the exit portion;

article sensing means, provided in each of the exit portions, for detecting a kind of the articles, the advancement of which is blocked in the exit portion by the blocking means; and carrying-in preparation/control means operating such that, in accordance with information for designating a plural number of articles to be carried into the article combining portion from the individual article carrying-in paths having the article sensing means provided therein, the carrying-in preparation/control means judges that the plural number of articles have been stacked in the exit portion, by a signal derived from the article sensing means, and then releases the articles from their state being blocked by the blocking means, to thereby allow the plural number of articles to be carried into the article combining portion.

3. The article combining device according to claim 1, wherein the articles are superposed on a single plate.

4. The article combining device according to claim 2, wherein the articles are superposed on a single plate.

* * * * *